United States Patent [19]

Moriarity et al.

[11] Patent Number: 4,543,740

[45] Date of Patent: Oct. 1, 1985

[54] BUTTON WORN NOVELTY DEVICE

[75] Inventors: Aaron J. Moriarity, Mound; Charles W. Girsch, St. Paul, both of Minn.

[73] Assignee: Girsch Design Associates, St. Paul, Minn.

[21] Appl. No.: 570,968

[22] Filed: Jan. 16, 1984

[51] Int. Cl.[4] ..... G09F 3/00

[52] U.S. Cl. ..... 40/315

[58] Field of Search ..... 24/90 A; 40/315; D2/449, 450, 451

[56] References Cited

U.S. PATENT DOCUMENTS

| | | | |
|---|---|---|---|
| 1,111,629 | 9/1914 | Wheatley | 40/315 |
| 1,821,428 | 10/1931 | Fenton | 40/315 |
| 3,777,336 | 12/1973 | Anderson | 40/315 |

*Primary Examiner*—Gene Mancene

*Assistant Examiner*—Cary E. Stone

*Attorney, Agent, or Firm*—Kinney & Lange

[57] ABSTRACT

A novelty device designed to be secured over a button on wearing apparel, the device being made of flexible material with a reinforcing member surrounding a portion of the figure and a buttonhole formed through the portion surrounded by the reinforcing member. Because of the flexible nature of the material, the buttonhole can be readily passed over the button. Because of the reinforcing member, the device is firmly held in position. The flexible material preferably has affixed thereto a representation of a figure and the flexible material may be cut out to follow the outline of the figure. The flexible material may be in the form of several pieces of different material. For example, it is possible to secure to the reinforcing members flexible coiled filamentary material to resemble hair.

6 Claims, 4 Drawing Figures

Fig. 1
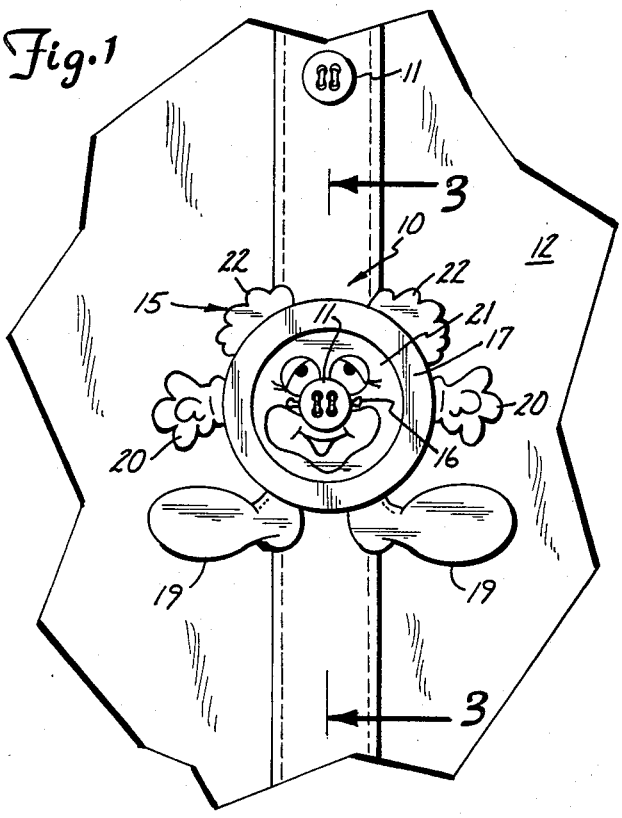
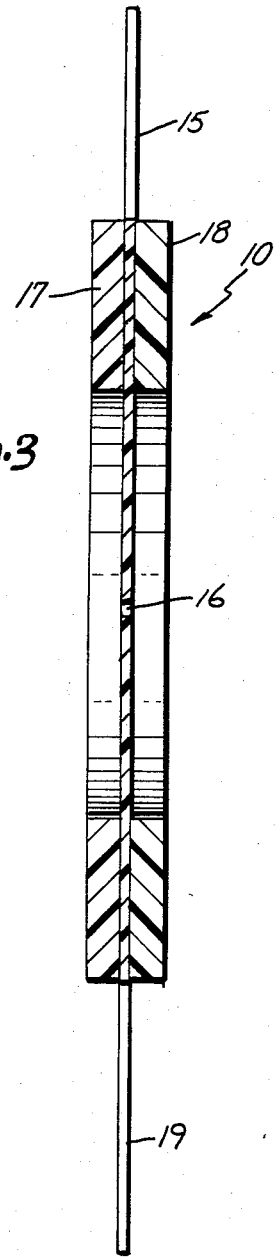
Fig. 3
Fig. 2
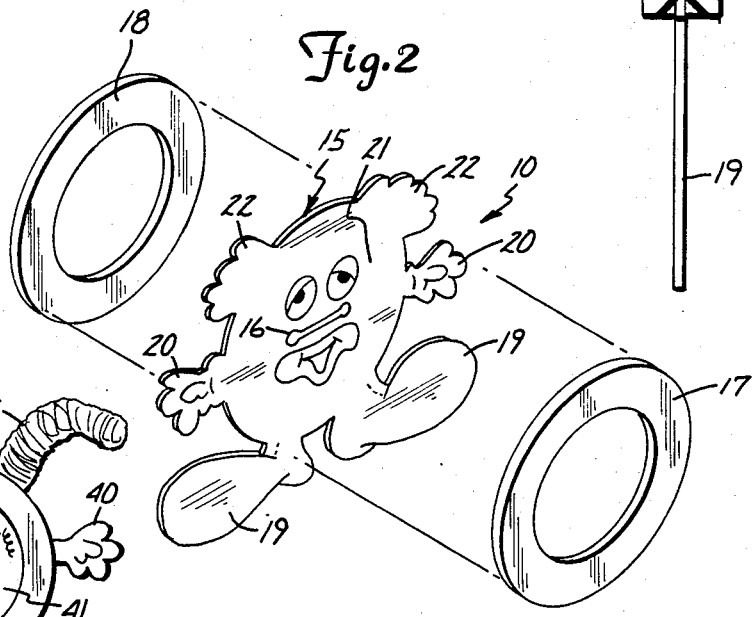
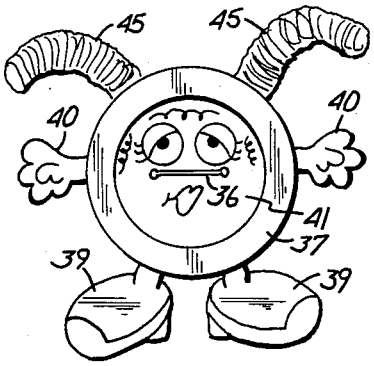
Fig. 4

BUTTON WORN NOVELTY DEVICE

BACKGROUND OF THE INVENTION

1. Field of the Invention

The invention pertains to a novelty device adapted to be worn over a button of a piece of apparel of the wearer.

2. Description of the Prior Art

It is extremely common to have various novelty devices which are secured to clothing. These may be secured in any of various ways as by means of a pin or adhesive material. It is desirable to have a device which can be readily secured to a garment without damage thereto and can be readily removed.

SUMMARY OF THE INVENTION

The present invention is concerned with a novelty device which is designed to be secured over a button of apparel worn by a person. The novelty device basically consists of a piece of flexible material having affixed thereto in any suitable manner, a representation of a figure. The flexible material has a reinforcing member surrounding a portion of the figure and a buttonhole extends through the material within the area defined by the reinforcing member. The device can be readily secured to a button by reason of the flexibility of the material and is retained in position more readily by reason of the reinforcing member which surrounds the area through which the buttonhole extends.

The reinforcing means may take the form of two relatively rigid rings disposed on opposite sides of the flexible material facing each other.

In one form of my invention, there may be several types of flexible material secured to the reinforcing means. For example, in one case, flexible material in a form simulating hair may be secured to the reinforcing ring.

Other features of the invention will be apparent from a consideration of the accompanying specification, claims and drawings.

BRIEF DESCRIPTION OF THE DRAWINGS

FIG. 1 is a view of a portion of a piece of wearing apparel, particularly a shirt, in which the novelty device of the present invention is secured over a button of the shirt.

FIG. 2 is an exploded view showing the manner in which the novelty device is assembled.

FIG. 3 is a vertical sectional view taken along the line 3—3 of FIG. 1.

FIG. 4 is a vertical plan view of a modification of the invention.

DETAILED DESCRIPTION OF THE PREFERRED EMBODIMENTS

Referring to FIG. 1, the novelty device of the present invention is generally indicated by the reference numeral 10. This device is being shown as secured over one of several buttons 11 of a piece of wearing apparel 12, such as a shirt. The device is formed of a piece of flexible material 15 with a buttonhole 16 through a portion thereof, the buttonhole being adapted to be secured over one of the buttons 11. The flexible material may be of heavy fabric or reinforced plastic or any other material which is flexible but still has sufficient body to retain its shape.

Surrounding the area in which the buttonhole 16 is located are a pair of relatively rigid rings 17 and 18 which, as best shown in FIGS. 2 and 3, are secured to opposite sides of the flexible material 15. These rings should be of relatively rigid material, such as a suitable plastic, and can be adhesively secured to opposite sides of the flexible material 15.

The flexible material 15 may be cut to form the outline of a suitable figure. As indicated in FIG. 1, this figure may have feet 19, hands 20, a face 21 and hair 22. The design of the face and hands is imprinted on the flexible material in any suitable way.

In the form shown, the buttonhole 16 is located within the center of the face 21 of the figure. It is understood, however, that the area in which the buttonhole is located might be in any other position of the body of the figure.

By reason of the reinforcing rings 17 and 18, the area surrounding the buttonhole 16 is reinforced. Because of the flexibility of the material 15, it is possible to readily pass a button 11 through the buttonhole 16. Thereafter, the device will be retained on the button. At any time when it is desired to remove the device, the button 11 can be readily passed through the buttonhole 16, allowing the device to be removed.

While we have shown two rings 17 and 18 for reinforcing the area around the buttonhole, it is to be understood that any other means can be employed as a reinforcing member.

While we have shown a single piece of material 15 as being employed as the flexible material, several different pieces of material may be employed. For example, in the modification in FIG. 4, we have shown a somewhat different figure. In this case, the figure is a caricature of a feminine person. In order to enable ready comparison, we have applied reference characters 20 numbers higher than those applied to the corresponding elements of species of FIGS. 1–3. Thus, the reinforcing ring in front is indicated by the reference number 37, the feet by the reference number 39, the hands by the reference number 40 and the face by the reference number 41. Secured to the reinforcing ring 37 are a plurality of curled portions 45 of filamentary material. These curled portions are intended to resemble hair of a female figure. It is of course understood that while I have only shown one ring 37, there may be a similar ring corresponding to ring 18 of the preferred species. The flexible material of the figure is secured between these rings. Again, there is a buttonhole 36 located within the area defined by the ring 37. This buttonhole is secured over a button just as in the preferred species.

While we have shown only two species, it is understood that the device may represent any desired figure. While we have shown two devices in the form of caricatures. It is to be understood that the figure may be an accurate depiction of some known figure.

While we have shown two species of our invention for purposes of illustration, it is to be understood that the invention is limited solely by the scope of the appended claims.

What is claimed is:

1. A novelty device designed to be secured to apparel worn by a person by means of a button of the apparel, said device comprising:

a member of flexible material having affixed thereto a representation of a figure;

said flexible material having a reinforcing member of relatively rigid material surrounding a portion of the figure, said reinforcing member being in the form of two relatively rigid rings of the same configuration secured to opposite sides of the flexible material and facing each other; and said flexible material having a buttonhole formed therethrough within the portion surrounded by the rings of the relatively rigid reinforcing member, said buttonhole being spaced from the rings of the rigid reinforced member so that the device can be secured to the apparel worn by a person by passing a button of the apparel through the buttonhole of the device, the buttonhole being designed to receive the button by reason of the flexibility of the material of the device within the portion surrounded by the reinforcing member.

2. The novelty device of claim 1 in which the device has an outline conforming with the outline of the figure thereon.

3. The novelty device of claim 1 in which the rigid rings of the reinforcing member are circular and in which the button hole is located within the circle defined by the rings of said reinforcing member.

4. The novelty device of claim 3 in which the button hole is located along a horizontal diameter of the circular rings.

5. The novelty device of claim 1 in which the flexible material consists of two different types of flexible material.

6. The novelty device of claim 5 in which one of the types of flexible material simulates hair of a figure.

* * * * *